US008798296B2

(12) United States Patent
Schmitt et al.

(10) Patent No.: US 8,798,296 B2
(45) Date of Patent: Aug. 5, 2014

(54) METHOD FOR OPERATING A HEARING DEVICE AS WELL AS A HEARING DEVICE

(75) Inventors: Nicola Schmitt, Stäfa (CH); Volker Kühnel, Männedorf (CH); Michael Boretzki, Rüti (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 13/695,456

(22) PCT Filed: May 6, 2010

(86) PCT No.: PCT/EP2010/056187

§ 371 (c)(1), (2), (4) Date: Nov. 15, 2012

(87) PCT Pub. No.: WO2011/137933

PCT Pub. Date: Nov. 10, 2011

(65) Prior Publication Data

US 2013/0208933 A1 Aug. 15, 2013

(51) Int. Cl.
*H04R 25/00* (2006.01)

(52) U.S. Cl.
USPC ..... 381/317; 381/315; 381/320; 381/109

(58) Field of Classification Search
USPC ..... 381/312–321, 104, 105, 109, 94.1, 381/94.2, 98
See application file for complete search history.

(56) References Cited

U.S. PATENT DOCUMENTS 6,035,050 A * 3/2000 Weinfurtner et al. ..... 381/313
6,580,798 B1 * 6/2003 Schaub ..... 381/312
6,910,013 B2 * 6/2005 Allegro et al. ..... 704/256
7,428,312 B2 * 9/2008 Meier et al. ..... 381/312
7,653,205 B2 * 1/2010 Allegro Baumann et al. ..... 381/313
7,664,280 B2 * 2/2010 Rass ..... 381/315
2002/0191799 A1 * 12/2002 Nordqvist et al. ..... 381/60

(Continued)

FOREIGN PATENT DOCUMENTS

EP 0064042 A1 11/1982
WO 00/78096 A2 12/2000

OTHER PUBLICATIONS

International Search Report for PCT/EP2010/056187 dated Dec. 21, 2010.
Written Opinion for PCT/EP2010/056187 dated Dec. 21, 2010.

(Continued)

*Primary Examiner* — Curtis Kuntz
*Assistant Examiner* — Joshua A Kaufman
(74) *Attorney, Agent, or Firm* — Pearne & Gordon LLP

(57) ABSTRACT

A method for better matching of the needs of mild to very mild hearing losses is obtained than with known hearing devices. The method comprising the steps of determining an acoustic situation by processing an input signal of a hearing device openly coupled to an ear of a user, selecting at least two hearing programs in dependence on the determined acoustic situation, at least one of the hearing programs being suitable for calm acoustic situations, and at least another one of the hearing programs being suitable for noisy acoustic situations, applying a gain only above a predefined frequency limit to the input signal if one of the hearing programs for calm acoustic situations is selected, and reducing noise in the input signal only in a frequency range within audible frequencies if one of the hearing programs for noisy acoustic situations is selected.

17 Claims, 3 Drawing Sheets

(56) References Cited

U.S. PATENT DOCUMENTS

| | | | | |
|---|---|---|---|---|
| 2004/0190738 | A1* | 9/2004 | Meier et al. | 381/312 |
| 2005/0078842 | A1* | 4/2005 | Vonlanthen et al. | 381/312 |
| 2006/0159285 | A1* | 7/2006 | Reber et al. | 381/98 |
| 2009/0185704 | A1* | 7/2009 | Hockley | 381/316 |
| 2010/0202637 | A1* | 8/2010 | Cornelisse et al. | 381/314 |
| 2012/0243715 | A1* | 9/2012 | Pedersen | 381/316 |

OTHER PUBLICATIONS

Kim, et al., "Hearing Aids: A Review of What's New", Otolaryngology and Head and Neck Surgery, Rochester, US, vol. 134, No. 6, Jun. 1, 2006, pp. 1043-1050.

* cited by examiner

METHOD FOR OPERATING A HEARING DEVICE AS WELL AS A HEARING DEVICE

FIELD OF THE INVENTION

The present invention is related to a method for operating a hearing device, to a hearing device as well as to an arrangement with a hearing device.

BACKGROUND OF THE INVENTION

Generally, a hearing device is used to improve the hearing of a hearing impaired person. Very often, a hearing device is only then used when the hearing loss of a patient has already reached a rather high degree. It has been shown that it is advantageous to use a hearing device even though only a mild hearing loss can be observed.

It is known that mild hearing losses are especially demanding regarding sound quality and hearing benefit because unaided hearing is always a strong alternative to aided hearing.

A typical solution taking into account a mild hearing loss is a small hearing device which is openly coupled to the ear canal of a person. These kinds of hearing devices are adjusted by a professional (e.g. an audiologist) to the individual needs. These hearing devices typically have means to recognize and distinguish different kinds of sound and process them differently. The professional can adjust the processing behavior for the distinguished sound classes, in some products one can separately adjust several hearing programs for different sound classes which are automatically selected and activated by the hearing device during usage according to the varying acoustic situations.

The acceptance of known hearing devices used to correct mild hearing losses is still rather low. Many customers reject the solution because the achieved hearing benefit such as improved audibility and intelligibility is not in a good relation to the cost of the hearing device. Besides the costs there are other reasons for rejection the use of a hearing device for correcting a mild hearing loss:

- artifacts, e.g. noise, distortion, reverberation-like sound quality due to a mixture of direct sound and the delayed sound coming from the hearing device receiver (known as comb filter effect, in particular when both sounds have roughly the same level);
- annoyance due to changes of sounds without hearing benefit;
- maintenance, e.g. costs for batteries and for cleaning, insertion of hearing device;
- expenditure in connection with getting the hearing device, e.g. the assessment and the fitting process.

These grounds for rejecting a hearing device compete with the fact that unaided hearing is just a bit worse than hearing with a hearing device.

It is therefore one object of the present invention to provide a hearing device, which does at least not have one of the above-mentioned drawbacks.

SUMMARY OF THE INVENTION

The present invention is first directed to a method for operating a hearing device that is openly coupled to an ear of a hearing device user. The inventive method comprising the steps of:

- determining a momentary acoustic situation by processing an input signal of the hearing device,

- selecting a hearing program out of at least two hearing programs in dependence on the determined momentary acoustic situation, at least one of the at least two hearing programs being suitable for calm acoustic situations, and at least another one of the at least two hearing programs being suitable for noisy acoustic situations,
- applying a gain only above a predefined frequency limit to the input signal of the hearing device if one of the at least one hearing program for calm acoustic situations is selected, and
- reducing noise in the input signal only in a frequency range within audible frequencies if one of the at least one hearing program for noisy acoustic situations is selected.

The hearing device according to the present invention remarkably better matches the needs of patients with mild to very mild hearing losses. In addition, the number of patients with mild hearing losses is a very large group having now a very efficient and easy to use solution.

In addition, the present invention has at least one of the following advantages for patients with a mild hearing loss:

- the costs are much less regarding the adjustment to the individual hearing loss because an easy self-adjustment is made possible;
- a better sound quality is obtained regarding the mixture of direct sound and processed sound (reduction of comb filter effect);
- a good audibility improvement is achieved for soft sounds in calm acoustic situations without audible internal noise of the hearing device;
- a better intelligibility in noisy acoustic situations is provided.

A further embodiment of the method according to the present invention further comprises the steps of:

- providing a control element for the hearing device user, the control element being suitable to adjust at least one parameter of the selected hearing program,
- adjusting the gain in accordance with activating the control element if one of the at least one hearing program for calm acoustic situations is selected, and
- adjusting the frequency range in accordance with activating the control element if one of the at least one hearing program for noisy acoustic situations is selected.

In further embodiments of the method according to the present invention, the gain basically remains unchanged when the frequency range is adjusted in accordance with activating the control element, while one of the at least one hearing program for noisy acoustic situations is selected.

In further embodiments of the method according to the present invention, the control element is arranged in one of the following components:

- hearing device;
- remote control;
- mobile phone;
- personal accessory device.

In further embodiments of the method according to the present invention, the predefined frequency limit is within a frequency band of 1000 Hz to 6000 Hz, particularly within 2500 Hz to 4000 Hz, more particularly within 3400 Hz to 3600 Hz.

In further embodiments of the method according to the present invention, the step of selecting a hearing program is performed automatically.

A further embodiments of the method according to the present invention, further comprises the step of smoothly changing from one hearing program to another as soon as a new momentary acoustic situation has been detected.

Furthermore, the present invention is also directed to a hearing device that is openly coupled to an ear of a hearing device user. The inventive hearing device comprises:

- means for determining a momentary acoustic situation by processing an input signal of the hearing device,
- means for selecting a hearing program out of at least two hearing programs in dependence on the determined momentary acoustic situation, at least one of the at least two hearing programs being suitable for calm acoustic situations, and at least another one of the at least two hearing programs being suitable for noisy acoustic situations,
- means for applying a gain only above a predefined frequency limit to the input signal of the hearing device if one of the at least one hearing program for calm acoustic situations is selected, and
- means for reducing noise in the input signal only in a frequency range within audible frequencies if one of the at least one hearing program for noisy acoustic situations is selected.

An embodiment of the hearing device according to the present invention further comprises:

- a control element for adjusting at least one parameter of the selected hearing program,
- means for adjusting the gain in accordance with activating the control element if one of the at least one hearing program for calm acoustic situations is selected, and
- means for adjusting the frequency range in accordance with activating the control element if one of the at least one hearing program for noisy acoustic situations is selected.

In further embodiments of the hearing device according to the present invention, the gain basically remains unchanged when the frequency range is adjusted in accordance with activating the control element, while one of the at least one hearing program for noisy acoustic situations is selected.

In further embodiments of the hearing device according to the present invention, the control element is arranged in a housing.

In further embodiments of the hearing device according to the present invention, the predefined frequency limit is within a frequency band of 1000 Hz to 6000 Hz, particularly within 2500 Hz to 4000 Hz, more particularly within 3400 Hz to 3600 Hz.

Further embodiments of the hearing device according to the present invention further comprise means for automatically selecting a hearing program.

Further embodiments of the hearing device according to the present invention further comprise means for smoothly changing from one hearing program to another as soon as a new momentary acoustic situation has been detected.

Finally, the present invention is directed to an arrangement with a hearing device as described above and with one of the following units comprising the control element:

- remote control;
- mobile phone;
- personal accessory device.

It is expressly pointed out that any combination of the above-mentioned embodiments, or combinations of combinations, is subject to a further combination. Only those combinations are excluded that would result in a contradiction.

BRIEF DESCRIPTION OF THE DRAWINGS

The present invention is further described by referring to drawings showing exemplified embodiments.

DETAILED DESCRIPTION OF THE INVENTION

Figure 1:
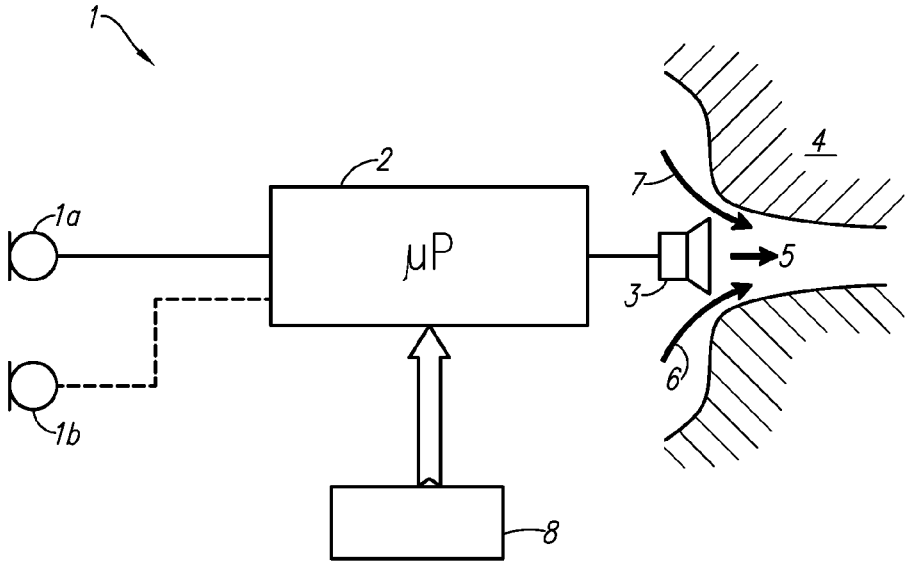
FIG. 1 shows a hearing device that is openly coupled to an ear of a hearing device user.

FIG. 1 schematically shows a hearing device 1 comprising one or two acoustical/electrical transducers 1*a*, 1*b*, e.g. microphones, a signal processing unit 2 and an electrical/acoustical transducer 3, called receiver in the field of hearing devices. The signal processing unit 2 is, on its input side, connected to the acoustical/electrical transducers 1*a*, 1*b* and, on its output side, connected to the electrical/acoustical transducer 3. The hearing device according to the present invention is a so called openly coupled hearing device, which means that the sound reaching the ear drum of the hearing device user is partly coming from the electrical/acoustical transducer 3 and partly as direct sound from the surrounding the hearing device user is in. This is illustrated in FIG. 1 by arrows 5, 6 and 7. FIG. 1 shows sections of an ear 4 and a corresponding ear canal of the hearing device user, the sound emitted by the electrical/acoustical transducer 3 being indicated by the arrow 5, and the direct sound of the surrounding being indicated by the arrows 6 and 7.

The present invention is related to the processing behavior of the hearing device 1. A further embodiment of the present invention is related to the kind how the hearing device 1 is adjusted to the individual needs of the hearing device user.

The hearing device 1 according to the present invention provides at least two hearing programs. A hearing program is related to a specific setting of the internal parameters that are used to process the input signal recorded by the acoustical/electrical transducers 1*a*, 1*b* of the hearing device 1. Each hearing program is designed to deal with a specific acoustic situation in a most favorable way. In the following, a list of possible hearing programs, characterized by its functions, is given:

- noise;
- speech in noise;
- music;
- speech, i.e. corresponds to a calm acoustic situation as defined below.

In an embodiment of the present invention comprising two hearing programs, one hearing program is for calm acoustic situations and the other hearing program is for noisy acoustic situations.

The term "calm acoustic situation", as it is used throughout this specification, is defined as an acoustic situation having a rather soft background, although a dominant dynamic sound source may be present, such as, for example, speech. In fact, the sub term "calm" in this term refers to the background and not to a possible dominant sound source. If only a soft background noise is present without a dominant sound source, one would still speak of a calm acoustic situation. The term "noisy acoustic situation", as it is used throughout this specification, is defined as an acoustic situation having at least in some frequency bands noise. One technique for detecting noise is to monitor the variability of the sound pressure level. If the variability of the sound pressure level is below a predefined variability, it can be concluded that noise is present. On the other hand, if the variability of the sound pressure level is above the predefined variability, it can be concluded that a calm acoustic situation is present.

While known hearing devices are adjusted in a so called fitting procedure carried out by an audiologist, for example, in order that an acceptable operation of the hearing device is obtained, the hearing device according to the present invention will usually not be adjusted in such a fitting procedure. Nevertheless, a fitting may also be carried out for the hearing device according to the present invention.

However, it is easier for many hearing device user to start using the hearing device without getting it adjusted by an audiologist before. The present invention allows adjusting the hearing device by the hearing device user himself in order to obtain a good operation of the hearing device. In this case, the hearing device is not adjusted using fitting software but simply by selection of one of a couple of settings which are accessible via a control at the hearing device or at a remote control being linked to the hearing device. This is further explained in detail later on in this description.

Figure 2:
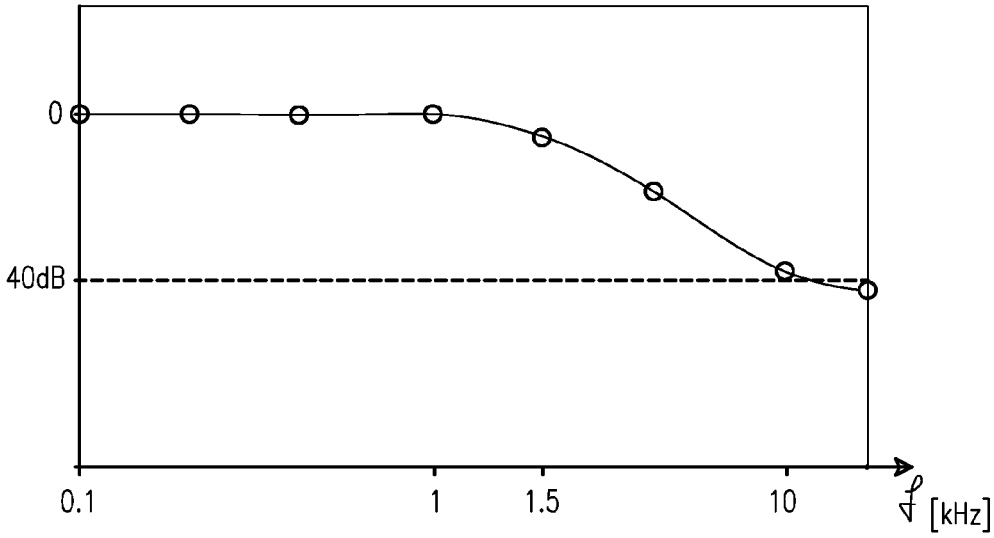
FIG. 2 shows an audiogram of a person having a mild hearing loss.

FIG. 2 shows an audiogram of a person having a mild hearing loss. In fact, the hearing device according to the present invention can very well be used for correcting mild hearing losses. However, the use of the inventive hearing device is not limited to improve the hearing for patients with mild hearing losses.

As can be seen from FIG. 2, a mild hearing loss is particularly reflected in a loss of hearing abilities for higher frequencies, for example above 1 or 1.5 kHz. In the example of FIG. 2, the hearing loss starts to drop at about 1.2 kHz and fall to 40 dB at 10 kHz. Therefore, this patient may observe a reduction of his hearing for sounds above 1.5 kHz.

Figure 5:
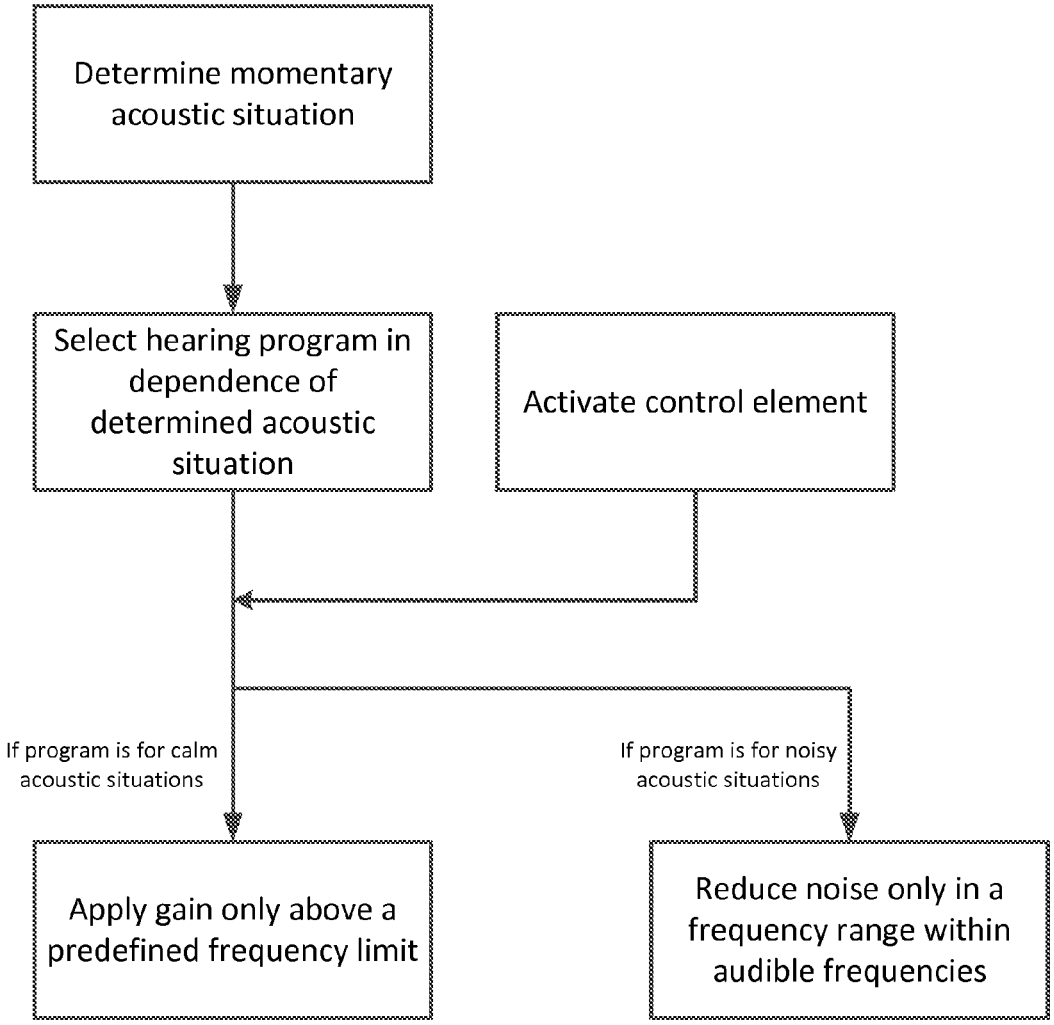
FIG. 5 shows a flow diagram of the method disclosed herein.

According to the present invention, and as shown in part in FIG. 5, the hearing device senses if the momentary acoustic situation is more likely a calm acoustic situation or a noisy one and activates the respective hearing program accordingly. Thereto, a classifier is implemented in the hearing device, i.e. in the signal processing unit. With the aid of the classifier, the signal of the acoustical/electrical transducer 1*a*, 1*b* is processed and it is determined which of the possible acoustic situation is most likely present. According to the determined momentary acoustic situation, a corresponding hearing program is selected. In a further embodiment of the present invention, this selection is performed automatically.

Figure 3:
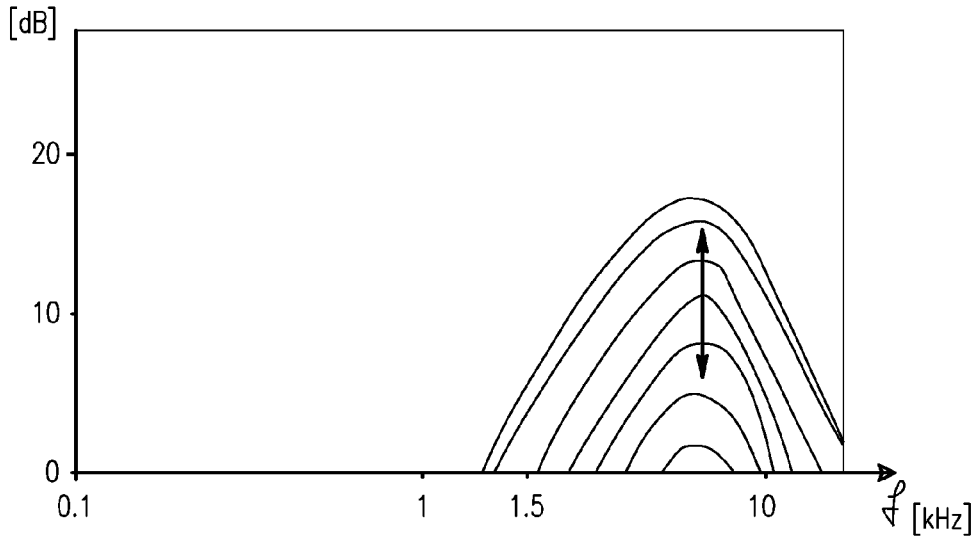
FIG. 3 shows a gain course as a function of frequency of a hearing program for calm acoustic situations.

FIG. 3 shows a first type of transfer functions that can be implemented in a hearing program for calm acoustic situations. In fact, FIG. 3 shows an array of transfer functions, the difference between the single transfer functions being explained later on.

In principle, a hearing program or a transfer function for calm acoustic situations is such that the frequencies above a predefined frequency limit are amplified. Of course, there is also an upper limit above which no amplification takes place (indicated by a falling transfer function at frequencies above 10 kHz, for example).

The predefined frequency limit may be in the frequency band of 1000 Hz to 6000 Hz, particularly within 2500 Hz to 4000 Hz, more particularly within 3400 Hz to 3600 Hz.

Figure 4:
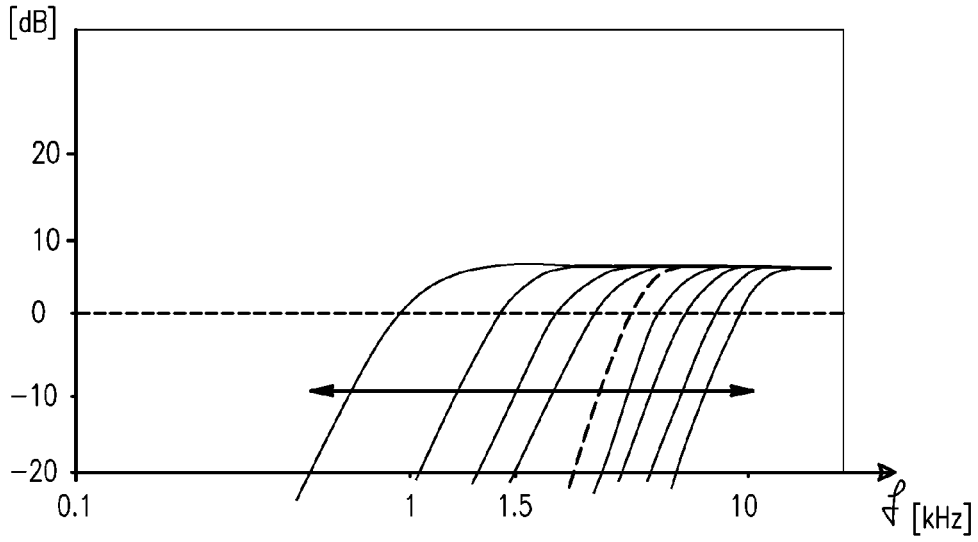
FIG. 4 shows different high pass filter functions in the frequency domain of a hearing program for noisy 5 acoustic situations.

FIG. 4 shows a second type of frequency transfer functions that can be implemented in a hearing program for noisy acoustic situations. As in FIG. 3 for calm acoustic situations, FIG. 4 shows an array of transfer functions, the difference between the single transfer functions being also explained later on.

In principle, a hearing program or a transfer function for noisy acoustic situations is such that basically no or only as much amplification is provided as much is needed to make a noise reduction algorithm effective. In one embodiment of the present invention, a noise reduction algorithm is acting on the frequency range that is not limited by the transfer function depicted in FIG. 4. Of course, there is also an upper limit above which no amplification takes place (indicated by a falling transfer function for frequencies above 10 kHz, for example). In another embodiment of the present invention, noise reduction is obtained by a known beam forming algorithm.

In a further embodiment of the present invention, as shown in part in FIG. 5, a control element is provided in order that the hearing device user may adjust one or more than one parameter of the hearing program that is currently active.

For example, a hearing program that is suitable for calm acoustic situations may be adjusted in the manner depicted in FIG. 3: A medium or standard setting in this hearing program results in applying the gain function indicated by a dashed line in FIG. 3. The hearing device user may change this setting by simply pressing a button on his hearing device or by pressing a button on his remote control, respectively, and a gain function having a higher gain or a gain function having a lower gain than the standard gain function will be applied to the output signal of the acoustical/electrical transducer.

For example, a hearing program that is suitable for noisy acoustic situations may be adjusted in the manner depicted in FIG. 4: A medium or standard setting in this hearing program results in applying a filter function indicated by a dashed line in FIG. 4. The hearing device user may again change this setting by simply pressing a button on his hearing device or by pressing a button on his remote control, respectively, and a filter function having a wider band pass or a filter function having a narrower band pass than the standard filter function will be applied to the output signal of the acoustical/electrical transducer. In fact, the user controls the width of the frequency range in which the noise reduction algorithm is applied.

As has already been pointed out, the control element may be a simple push button on the hearing device, i.e. attached or integrated in the housing of the hearing device as rod, switch, etc., or the control element may be integrated in a remote control that is operationally connected to the hearing device via a wireless link or via a cable. In FIG. 1, the effect of such a control element is indicated by a signal flow arrow 10 pointing towards the signal processing unit 2.

From the hearing program examples described in connection with FIGS. 3 and 4, it is apparent that activating the control element has not the same effect in each of the two hearing programs. The function and effect of activating the control element depends on the selected hearing program.

If the hearing device user activates the control element at the hearing device when the hearing program for calm acoustic situations is selected, the spectrally maximum gain is increased and the low frequency slope get only slightly flatter. With a conventional hearing device for correcting mild hearing losses, generally slopes are much flatter and the maximum gain is at a lower frequency than with the inventive hearing device. The lower spectral gain peak leads to more sharpness and shrillness with the conventional hearing device. The flatter frequency response leads to broader frequency regions in which the comb filter effect can cause reduced sound quality.

In order to avoid the comb filter effect, all gain settings—for calm acoustic situations as well as for noisy acoustic situation—must be such that the low frequency slopes are rather steep. If this condition is not met, a reverberating effect will occur due to interference of direct sound and sound of the electrical/acoustical transducer. The reverberating effect will particularly be strong for similar sound levels of the direct sound and of the sound of the electrical/acoustical transducer. Therefore, a predetermined frequency limit is determined as has already been described above.

For both hearing programs of FIGS. 3 and 4, the hearing device user can select more than one setting by activating the control element. The settings are designed such that from the smallest to the largest hearing loss of the target group—mild losses—a setting is available which is suitable for the individual hearing loss. This is valid for calm acoustic situations in which the hearing device must overcome the typical high frequency hearing loss of individuals with mild hearing loss.

The hearing program for noisy acoustic situations is not designed to compensate audibility loss like the hearing program for calm situations in which the soft sounds must be restored. It is designed to best clean the sound from noise. So the typical audiogram of mild hearing losses is not of help for this program but the acoustic condition under which the hearing device effectively can suppress noise. According to the present invention, this is achieved by a noise canceller or by a beam-former, for example. Noise suppression is only possible if the output of the hearing device is above the direct sound. The higher this difference the more room is available for noise suppression.

In order to achieve this, the low frequency slopes of the gain settings are kept steep. An increase by activating the control element of the hearing device not so much increases the spectrally maximum gain but moves the low frequency slope of the response to lower and lower frequencies. Spectrally maximum gain is set such that the processed sound is sufficiently above the direct sound, e.g. 8 dB above the direct sound, by that enabling sound cleaning. By activating the control element in order to increase the influence of the hearing program, the frequency range in which the hearing device can effectively apply noise cancelling or beam forming gets broader and broader.

In one embodiment the hearing device is not adjusted with a fitting software but with the said one single control element which manages all settings for the at least two hearing programs for two different sound classes. The control element used in the inventive hearing device works relative to a "middle" or standard setting of the at least two hearing programs. The control element offers to apply at least one change into the direction of more hearing support and one into the opposite direction. The applied deltas to the gain response are different in order to achieve the desired behaviour. In addition, the deltas applied in the hearing program for calm acoustic situations and in the hearing program for noisy acoustic situations are different.

The invention claimed is:

1. A method for operating a hearing device that is openly coupled to an ear of a hearing device user, the method comprising the steps of:

determining a momentary acoustic situation by processing an input signal of the hearing device, selecting a hearing program out of at least two hearing programs in dependence on the determined momentary acoustic situation, at least one of the at least two hearing programs being suitable for calm acoustic situations, and at least another one of the at least two hearing programs being suitable for noisy acoustic situations, applying a gain only above a predefined frequency limit to the input signal of the hearing device if one of the at least one hearing program for calm acoustic situations is selected, and reducing noise in the input signal only in a frequency range within audible frequencies if one of the at least one hearing program for noisy acoustic situations is selected, providing a control element for the hearing device user, the control element being a user input device suitable to adjust at least one parameter of the selected hearing program, adjusting the gain in response to activating the control element if one of the at least one hearing program for calm acoustic situations is selected, and adjusting the frequency range in response to activating the control element if one of the at least one hearing program for noisy acoustic situations is selected, wherein said adjusting in response to activating the control element depends on the selected hearing program.

2. The method of claim 1, wherein the gain basically remains unchanged when the frequency range is adjusted in response to activating the control element, while one of the at least one hearing program for noisy acoustic situations is selected.

3. The method of claim 1, wherein the control element is arranged in one of the following components:

hearing device;

remote control;

mobile phone;

personal accessory device.

4. The method of claim 1, wherein the predefined frequency limit is within a frequency band of 1000 Hz to 6000 Hz.

5. The method of claim 1, wherein the step of selecting a hearing program is performed automatically.

6. The method of claim 1, further comprising the step of smoothly changing from one hearing program to another as soon as a new momentary acoustic situation has been detected.

7. The method of claim 1, wherein the predefined frequency limit is within a frequency band of 2500 Hz to 4000 Hz.

8. The method of claim 1, wherein the predefined frequency limit is within a frequency band of 3400 Hz to 3600 Hz.

9. A hearing device that is openly coupled to an ear of a hearing device user, the hearing device comprising:

means for determining a momentary acoustic situation by processing an input signal of the hearing device, means for selecting a hearing program out of at least two hearing programs in dependence on the determined momentary acoustic situation, at least one of the at least two hearing programs being suitable for calm acoustic situations, and at least another one of the at least two hearing programs being suitable for noisy acoustic situations, means for applying a gain only above a predefined frequency limit to the input signal of the hearing device if one of the at least one hearing program for calm acoustic situations is selected, and means for reducing noise in the input signal only in a frequency range within audible frequencies if one of the at least one hearing program for noisy acoustic situations is selected, a user input control element for adjusting at least one parameter of the selected hearing program, means for adjusting the gain in response to activating the control element if one of the at least one hearing program for calm acoustic situations is selected, and means for adjusting the frequency range in response to activating the control element if one of the at least one hearing program for noisy acoustic situations is selected, wherein said adjusting in response to activating the control element depends on the selected hearing program.

10. The hearing device of claim 9, wherein the gain basically remains unchanged when the frequency range is adjusted in response to activating the control element, while one of the at least one hearing program for noisy acoustic situations is selected.

11. The hearing device of claim 9, wherein the control element is arranged in a housing.

12. The hearing device of claim 9, wherein the predefined frequency limit is within a frequency band of 1000 Hz to 6000 Hz.

13. The hearing device of claim 9, further comprising means for automatically selecting a hearing program.

14. The hearing device of claim 9, further comprising means for smoothly changing from one hearing program to another as soon as a new momentary acoustic situation has been detected.

15. An arrangement with a hearing device according to claim 9 and with one of the following units comprising the control element:

remote control;

mobile phone;

personal accessory device.

16. The hearing device of claim 9, wherein the predefined frequency limit is within a frequency band of 2500 Hz to 4000 Hz.

17. The hearing device of claim 9, wherein the predefined frequency limit is within a frequency band of 3400 Hz to 3600 Hz.

* * * * *